US005992549A

United States Patent [19]

Fuller

[11] Patent Number: 5,992,549

[45] Date of Patent: Nov. 30, 1999

[54] CUTTING STRUCTURES FOR ROTARY DRILL BITS

[75] Inventor: John Michael Fuller, Nailsworth, United Kingdom

[73] Assignee: Camco Drilling Group Limited, Stonehouse, United Kingdom

[21] Appl. No.: 08/949,178

[22] Filed: Oct. 10, 1997

[30] Foreign Application Priority Data

Oct. 11, 1996 [GB] United Kingdom ..... 9621216

[51] Int. Cl.[6] ..... E21B 10/46; E21B 10/62

[52] U.S. Cl. ..... 175/431; 175/432

[58] Field of Search ..... 175/431, 379, 175/57, 429, 428, 426, 432

[56] References Cited

U.S. PATENT DOCUMENTS

| | | | |
|---|---|---|---|
| 4,303,136 | 12/1981 | Ball . | |
| 4,538,690 | 9/1985 | Short, Jr. | 175/329 |
| 4,558,753 | 12/1985 | Barr | 175/431 |
| 4,723,612 | 2/1988 | Hicks . | |
| 4,907,662 | 3/1990 | Deane et al. . | |
| 4,942,933 | 7/1990 | Barr | 175/431 X |
| 5,115,873 | 5/1992 | Pastusek | 175/65 |
| 5,172,778 | 12/1992 | Tibbitts et al. | 175/420 |
| 5,199,511 | 4/1993 | Tibbitts et al. | 175/65 |
| 5,447,208 | 9/1995 | Lund et al. | 175/428 |
| 5,582,258 | 12/1996 | Tibbitts et al. . | |

FOREIGN PATENT DOCUMENTS

| | | |
|---|---|---|
| 0322347 | 6/1989 | European Pat. Off. . |
| 0325271 | 7/1989 | European Pat. Off. . |
| 0656458 | 6/1995 | European Pat. Off. . |
| 2298665 | 9/1996 | United Kingdom . |
| 2298666 | 9/1996 | United Kingdom . |

*Primary Examiner*—Frank Tsay
*Attorney, Agent, or Firm*—Jeffrey E. Daly

[57] ABSTRACT

A cutting structure for a rotary drag-type drill bit includes a preform cutting element mounted on a carrier which, in use, is mounted on the drill bit and comprises a front facing table of superhard material bonded to a less hard substrate. A portion of the carrier on which the preform cutting element is mounted is shaped, adjacent the cutting element, for engagement by a chip of formation material being removed by the cutting element from the formation being drilled so as to tend to break the chip away from the surface of the formation. A portion of the carrier, or a portion of the bit body itself, may also be shaped, adjacent the cutting element, to direct to a location in front of the cutting element a flow of drilling fluid which impinges on said surface so as to assist in chip removal.

21 Claims, 2 Drawing Sheets

FIG 1
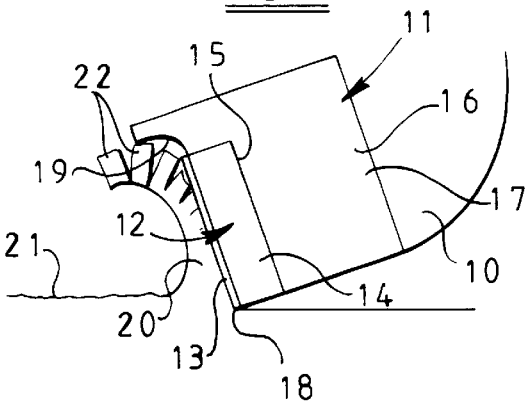
FIG 2
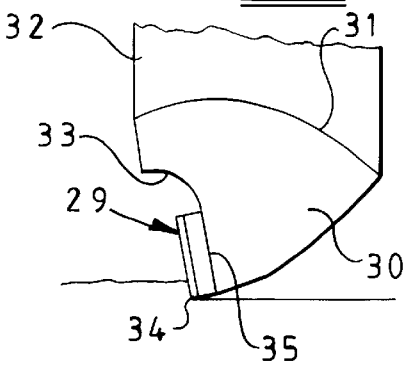
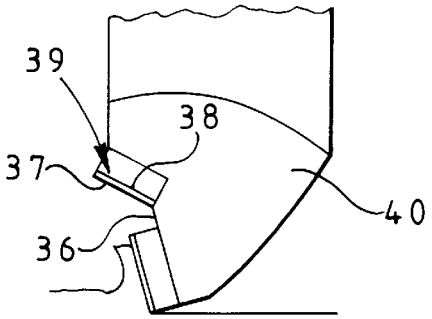
FIG 3
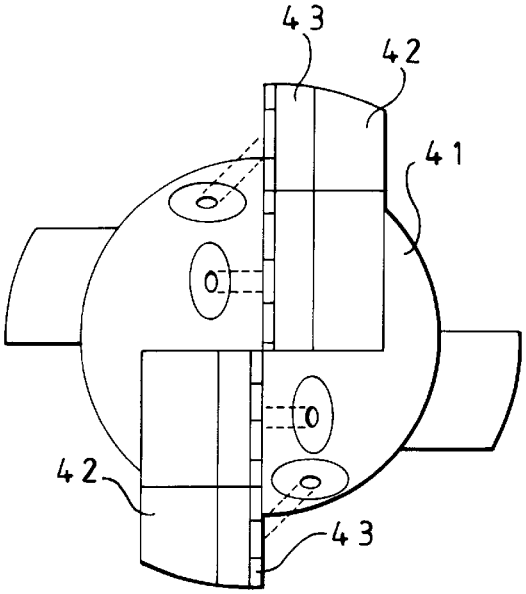
FIG 4
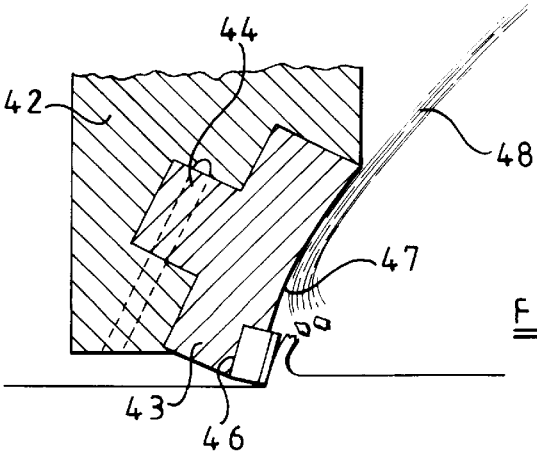
FIG 5

FIG 6
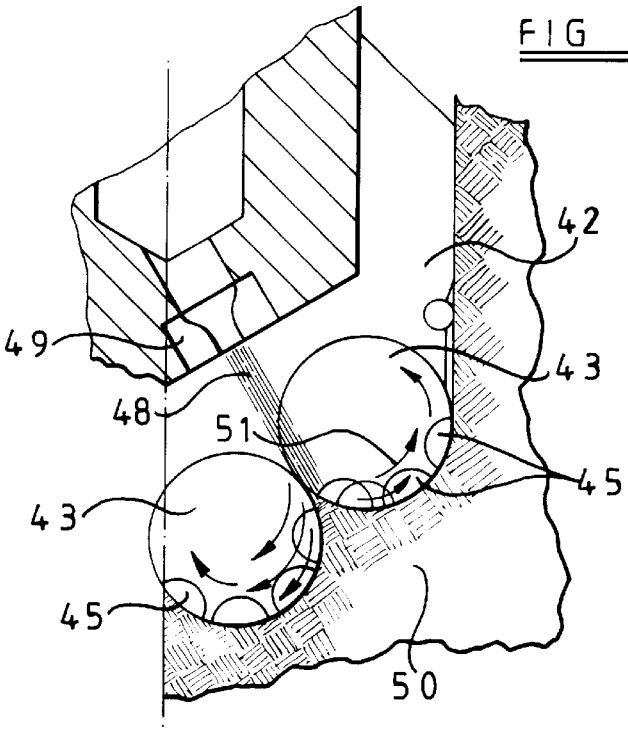
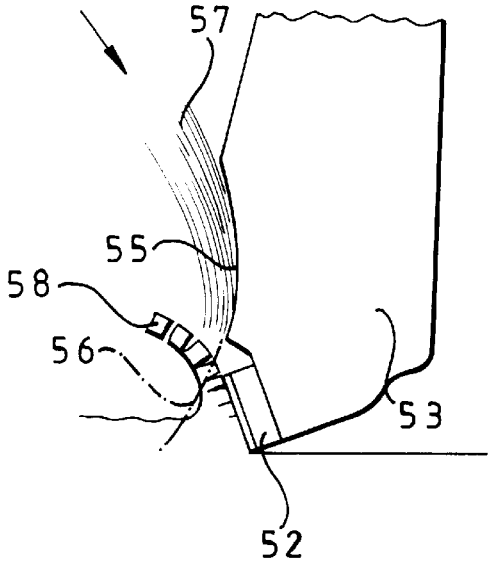
FIG 7
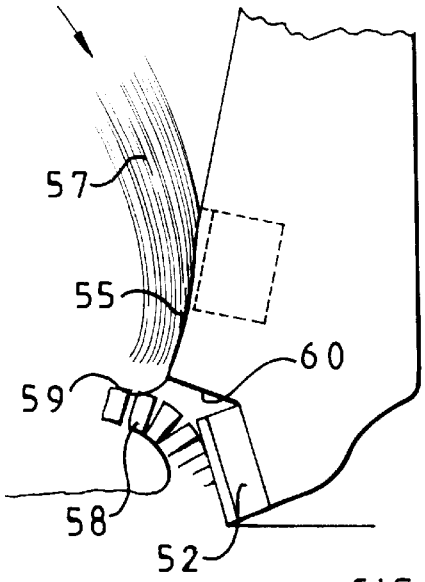
FIG 8

CUTTING STRUCTURES FOR ROTARY DRILL BITS

BACKGROUND OF THE INVENTION

1. Field of the Invention

The invention relates to cutting structures for rotary drag-type drill bits, for use in drilling or coring holes in subsurface formations.

2. Description of Related Art

Rotary drag-type drill bit usually include a bit body having a shank for connection to a drill string, a plurality of cutting structures at the surface of the bit body, and a passage in the bit body for supplying drilling fluid to the surface of the bit body for cooling and/or cleaning the cutters. Each cutting structure includes a preform cutting element comprising a front facing table of superhard material bonded to a less hard substrate. The cutting element may be mounted on a carrier, also of a material which is less hard than the superhard material, which is mounted on the body of the drill bit, for example, is secured within a socket on the bit body. Alternatively, the cutting element may be mounted directly on the bit body, for example the substrate may be of sufficient axial length that it may itself be secured within a socket on the bit body.

In drag-type drill bits of this kind the bit body may be machined from metal, usually steel, and sockets to receive the carriers or the cutting elements themselves are machined in the bit body. Alternatively, the bit body may be moulded from tungsten carbide matrix material using a powder metallurgy process. Drag-type drill bits of this kind are particularly suitable for drilling softer formations. However, when drilling soft, sticky shale formations in a water based mud environment, and in other similar conditions, there may be a tendency for the shavings or chips of formation gouged from the surface of the borehole not to separate from the surface and to be held down on the surface of the formation by the subsequent passage over the shaving or chip of other cutters and parts of the drill bit. Also, there may be a tendency for such material to adhere to the surface of the bit body, a phenomenon known as "bit balling", eventually resulting in the bit becoming ineffective for further drilling.

Attempts have been made to alleviate this problem by suitably shaping the bit body itself adjacent each cutting element, so that chips or shavings of material removed from the formation by the cutting element engage the shaped part of the bit body in such a manner as to tend to break the chip or shaving away from the surface of the formation. Arrangements of this type are disclosed, for example, in U.S. Pat. No. 5,582,258. The effectiveness of such arrangements depends on the accurate location, shape and orientation of the shaped part of the bit body in relation to the location, shape and orientation of the cutting element, and difficulties can arise in ensuring the required cooperative relationship between the cutting element and the shaped part.

For example, it is usually necessary or desirable that all shaping of the bit body is completed before the cutting elements are mounted on the bit body. This is particularly the case when the bit body is moulded using a powder metallurgy process. This means that all the shaped parts of the bit body must be formed before the cutting elements are mounted on it, and accordingly any subsequent tolerances in the subsequent location and orientation of a cutting element may result in it not being in the optimum relation to the shaped part of the bit body. Also, each design of bit body is only suitable for one arrangement of cutting elements, since the orientation of the cutting elements is determined by the shaped parts of the bit body. It is not possible to employ on the bit body cutting structures in which the cutting elements have orientations (such as back rake, side rake etc.) which differ from those for which the shaped parts of the bit body are suitable.

SUMMARY OF THE INVENTION

According to the present invention, each cutting element is mounted on a carrier, so as to form a unitary cutting structure which may be mounted on the bit body as a unit, and it is the carrier, and not the bit body itself, which is shaped to break chips removed from the formation by the cutting element. This enables the cutting element and shaped part of the carrier to be accurately matched to one another, in shape, position and orientation, when the cutting structure is manufactured, and this relationship is not affected by the manner in which the cutting structure is subsequently mounted on the bit body, regardless of any tolerances in such fitting. Also, the bit body merely has to be provided with sockets suitably shaped and located to receive the cutting structures, thus allowing the cutting structures to be mounted in different orientations on different bit bodies of the same design, or allowing different designs of cutting structures to be fitted, all without interfering with the required cooperative relationship between each cutting element and its associated shaped part of the carrier on which it is mounted.

According to one aspect of the invention, therefore, there is provided a cutting structure for a rotary drag-type drill bit including a preform cutting element mounted on a carrier which, in use, is mounted on the drill bit and comprising a front facing table of superhard material bonded to a less hard substrate, wherein a portion of the carrier on which the preform cutting element is mounted is shaped, adjacent the cutting element, for engagement by a chip of formation material being removed by the cutting element from the formation being drilled so as to tend to break the chip away from the surface of the formation. Since, in use, the configuration of the cutting structure serves to break the chips away from the surface of the formation, there is less tendency for the chip to be held down on to the surface of the borehole or to coagulate on the surface of the bit body to cause bit balling.

The carrier may be formed of a material which is less hard than the superhard material of the cutting element. For example, the carrier may be formed of the same material as the substrate of the preform cutting element. The carrier on which the preform cutting element is mounted may be formed with a shaped surface which extends away from the cutting element, on the side thereof remote from its cutting edge, the surface extending from a region which is rearward of the front surface of the facing table, with respect to the normal direction of forward movement of the cutting element in use, to a region which is in front of said front surface.

Said shaped surface may be smoothly and concavely curved as it extends forwardly away from the cutting element. A tangent to the portion of said surface most closely adjacent the cutting element may extend generally parallel to the front surface of the cutting element. A tangent to the portion of said surface furthest from the cutting element may extend generally at right angles to the front surface of the cutting element.

Said shaped surface may comprise two or more substantially planar portions arranged at an angle to one another as they extend away from the cutting element. Said shaped surface may comprise a continuation of a surface on said carrier to which the substrate of the cutting element is bonded. The shaped surface may include a portion faced with superhard material. For example, a further preform compact, comprising a front facing table of superhard material bonded to a less hard substrate, may be mounted on said carrier so that the front face of the superhard material forms part of said shaped surface on the carrier. Preferably the portion of the shaped surface faced with superhard material intersects the plane containing the front surface of the cutting element.

The present invention also provides arrangements whereby the hydraulic power of the drilling fluid supplied to the surface of the bit body may be employed to assist in the removal of cuttings from the formation or from the cutting elements. According to a second aspect of the invention there is provided a cutting structure for a rotary drag-type drill bit including a preform cutting element mounted on a member on the drill bit and comprising a front facing table of superhard material bonded to a less hard substrate, wherein a portion of the member on which the preform cutting element is mounted is shaped, adjacent the cutting element, to direct to a location in front of the cutting element, with respect to the normal direction of forward movement of the cutting element in use, a flow of drilling fluid which impinges on said surface.

As in the first aspect of the invention, the member on which the preform element is mounted may comprise a carrier which is in turn mounted on the bit body, but in this second aspect of the invention the member may also comprise a part of the bit body itself.

Preferably said shaped surface is formed on a portion of said member which overhangs the front surface of the facing table of the cutting element. Preferably the surface has an edge adjacent the cutting element, and an imaginary extension of the surface beyond said edge is spaced forwardly of the cutting element. Preferably the shaped surface is smoothly and concavely curved as it extends towards the cutting element.

Said shaped surface may be hard faced, for example may have a surface coating of hard facing material applied thereto. Alternatively, the shaped surface may include a portion faced with superhard material. For example, a further preform compact, comprising a front facing table of superhard material bonded to a less hard substrate, may be mounted on the member so that the front face of the superhard material forms part of said shaped surface on the member.

BRIEF DESCRIPTION OF THE DRAWINGS

FIGS. 1 to 3 are diagrammatic sections through cutting structures according to the invention on a rotary drag-type drill bit.

FIG. 4 is an end view of a drill bit incorporating a different type of cutting structure.

FIG. 5 is a diagrammatic section through a cutting structure of the type used on the drill bit of FIG. 4.

FIG. 6 is a diagrammatic vertical half-section through the drill bit of FIG. 5.

FIGS. 7 and 8 are diagrammatic sections through further forms of cutting structure according to the invention.

DETAILED DESCRIPTION OF THE PREFERRED EMBODIMENTS

Referring to FIG. 1, the body of the drill bit is formed, in well known manner, with a plurality of blades 10 extending generally outwardly away from the central longitudinal axis of rotation of the drill bit. Spaced apart side-by-side along the leading face of each blade is a plurality of cutting structures 11. Each cutting structure comprises a cutting element 12 in the form of a circular tablet having a thin front cutting table 13 of polycrystalline diamond or other superhard material bonded in a high pressure, high temperature press to a substrate 14 of less hard material, such as cemented tungsten carbide. The cutting element 12 is brazed within a rebate 15 on a generally cylindrical carrier 16 which is also formed from cemented tungsten carbide.

The cylindrical carrier 16 is received within a correspondingly shaped socket or recess 17 in the blade 10. The carrier 16 will usually be brazed or shrink-fitted in the socket. On the side of the cutting element 12 remote from its cutting edge 18, the carrier 16 is formed with a concave surface 19 which extends around a portion of the periphery of the cutting element 12 opposite its cutting edge 18. Alternatively the concave surface 19 may be cylindrical. The edge of the curved surface 19 closest to the cutting element 12 meets the cutting element rearwardly of the front face of the facing table 13 and a tangent to the surface at that point is substantially parallel to the front face of the facing table. The curved surface 19 then extends to a region forwardly of the facing table 13 to a point where its tangent is substantially at right angles to the front face of the facing table.

FIG. 1 shows the cutting structure in use gouging a shaving or chip 20 from the surface of the formation 21 of the borehole. As the chip 20 is lifted from the formation it passes upwardly across the front face of the cutting element 12, and when it engages the curved surface 19, the surface causes it to tend to break into fragments, as indicated diagrammatically 22. The chip is thus broken up and the particles can readily be washed away by the drilling fluid that is passing under pressure across the cutting structures, thereby reducing the tendency for cuttings to adhere to the cutting structures or to be held down on the surface of the formation.

FIG. 2 is another arrangement in which the cutting element 29 is mounted on a tungsten carbide carrier 30 which is received in a socket 31 in a blade 32 on the bit body. In this arrangement the carrier 30 is generally in the form of part of a sector of a circle and may be generally of the kind described in British Patent Specification No. 2298665. In this case also, the carrier 30 is formed with a shaped concave surface 33 on the side of the cutting element 29 opposite its cutting edge 34. In this case the surface 33 forms a continuation of the surface 35 on the carrier 30 to which the cutting element 29 is brazed.

FIG. 3 shows a modification of the arrangement of FIG. 2 where the shaped surface comprises two generally planar surfaces 36, 37 arranged at an angle to one another. The surface 37 comprises the front surface of the facing table 38 in a preform polycrystalline diamond compact 39 which is brazed into a suitably shaped recess on the carrier 40. The compact 39 receives the direct impact of chips being removed from the formation and thus provides the cutting structure with substantial resistance to wear and erosion due to impact by the chips.

FIG. 4 is an end view of a drill bit having a different form of cutting structure according to the invention. In this case the bit body 41 is formed with two blades 42 as best seen in FIGS. 5 and 6, each blade 42 has two circular carriers 43 mounted side-by-side thereon. Each carrier 43 is generally circular and is formed on its rear surface with a cylindrical stud portion 44 received in an appropriately shaped socket in the blade 42.

As best seen in FIG. 6, each carrier 43 has mounted around the lowermost portion of its periphery a number of generally semi-circular preform cutting elements 45. Each cutting element 45 comprises a facing table of polycrystalline diamond bonded to a substrate of tungsten carbide and is brazed within a suitably shaped socket 46 in the circular carrier 43. The front face of the carrier 43 is formed with a part-spherical concave surface 47 which performs two functions. It acts in similar fashion to the concave surfaces 19, 28, 33 in the arrangements of FIGS. 1 and 2, but it also directs a jet of drilling fluid 48 from a nozzle 49 associated with the carrier downwardly past the cutting element 45 and on to the formation in front of the cutting element. This also serves to clean the chips of formation from the front of the cutting elements 45 as they are broken up by the curvature 47 in the front face of the carrier.

As best seen in FIG. 6, the shape of the carriers 43 forms two part-circular groove side-by-side in the formation 50 and the nozzle 49 is so located that the jet 48 of drilling fluid flows around the bottom of the grooves in the formation and sweeps across the cutting elements 45 as indicated by the arrows 51.

FIG. 7 is a diagrammatic section through a cutting structure comprising a polycrystalline diamond preform element 52 mounted on a cemented tungsten carbide carrier 53 which is received in a socket in the bit body (not shown). In this case a portion of the carrier on the side of the cutting element 52 remote from its cutting edge is formed with a concavely curved surface 55 an imaginary extension of which, as indicated in dotted lines at 56, is spaced forwardly of the cutting element 52. In this case a jet 57 of drilling fluid is directed downwardly by the curved surface 55 so as to impinge on chips 58 of formation being raised from the surface of the borehole by the cutting element 52 and breaks the chips away from the cutting element and from the surface of the formation as a result of the hydraulic pressure.

FIG. 8 shows a modified arrangement where the hydraulic effect of FIG. 7 is combined with the mechanical effect of FIGS. 1–3. In this case the edge 59 of the concavely curved surface 55 is located forwardly of the front surface of the cutting element 52 so that the chips of formation 58 impinge on the undersurface 60 and are thus mechanically broken up in addition to the breaking up effect of the jet 57 of drilling fluid. In the arrangements of FIGS. 7 and 8, a PDC element may be set into the surface 55 to resist erosion of the surface by the jet of drilling fluid. In any of the arrangements in accordance with the present invention, the interface between the facing table and substrate of the cutting element may be non-planar and configured, instead of being substantially flat, so as to improve the bond between the facing table and substrate and also to provide other advantages, as is well known in the art. Alternatively or in addition, there may be provided between the facing table and the substrate a transition layer which may, for example, have certain characteristics, such as hardness, which are intermediate the corresponding characteristics of the facing table and substrate.

Whereas the present invention has been described in particular relation to the drawings attached hereto, it should be understood that other and further modifications, apart from those shown or suggested herein, may be made within the scope and spirit of the present invention.

What is claimed:

1. A cutting structure for a rotary drag-type drill bit including a perform cutting element comprising a front facing table of superhard material bonded to a less hard substrate, the preform cutting element being mounted on a separately formed carrier so that the cutting element and carrier together form a unitary cutting structure which, in use, may be mounted as a unit on the drill bit, and wherein a portion of the carrier on which the preform cutting element is mounted is shaped, adjacent the cutting element, for engagement by a chip of formation material being removed by the cutting element from the formation being drilled so as to tend to break the chip away from the surface of the formation.

2. A cutting structure according to claim 1, wherein the carrier is formed of a material which is less hard than the superhard material of the cutting element.

3. A cutting structure according to claim 2, wherein the carrier is formed of the same material as the substrate of the preform cutting element.

4. A cutting structure according to claim 1, wherein the carrier is formed with a shaped surface which extends away from the cutting element, on the side thereof remote from its cutting edge, the surface extending from a region which is rearward of the front surface of the facing table, with respect to the normal direction of forward movement of the cutting element in use, to a region which is in front of said front surface.

5. A cutting structure according to claim 4, wherein said shaped surface is smoothly and concavely curved as it extends forwardly away from the cutting element.

6. A cutting structure according to claim 5, wherein a tangent to the portion of said surface most closely adjacent the cutting element extends generally parallel to the front surface of the cutting element.

7. A cutting structure according to claim 5, wherein a tangent to the portion of said surface furthest from the cutting element extends generally at right angles to the front surface of the cutting element.

8. A cutting structure according to claim 4, wherein said shaped surface comprises two or more substantially planar portions arranged at an angle to one another as they extend away from the cutting element.

9. A cutting structure according to claim 4, wherein said shaped surface comprises a continuation of a surface on said carrier to which the substrate of the cutting element is bonded.

10. A cutting structure according to claim 4, wherein the shaped surface includes a portion faced with superhard material.

11. A cutting structure according to claim 10, wherein a further preform compact, comprising a front facing table of superhard material bonded to a less hard substrate, is mounted on said carrier so that the front face of the superhard material forms part of said shaped surface on the carrier.

12. A cutting structure according to claim 10, wherein the portion of the shaped surface faced with superhard material intersects the plane containing the front surface of the cutting element.

13. A cutting structure for a rotary drag-type drill bit including a preform cutting element comprising a front facing table of superhard material bonded to a less hard substrate, the preform cutting element being mounted on a separately formed carrier so that the cutting element and carrier together form a unitary cutting structure which, in use, may be mounted as a unit on the drill bit, and wherein a portion of the carrier on which the preform cutting element is mounted is shaped, adjacent the cutting element, to provide a surface to direct to a location in front of the cutting element, with respect to the normal direction of forward movement of the cutting element in use, a flow of drilling fluid which impinges on said surface.

14. A cutting structure according to claim 13, wherein the shaped member on which the preform element is mounted comprises a carrier which is, in use, mounted on the bit body.

15. A cutting structure according to claim 13, wherein the shaped member on which the preform element is mounted comprises a part of the bit body itself.

16. A cutting structure according to claim 13, wherein said shaped surface is formed on a portion of said member which overhangs the front surface of the facing table of the cutting element.

17. A cutting structure according to claim 16, wherein said shaped surface has an edge adjacent the cutting element, and an imaginary extension of the surface beyond said edge is spaced forwardly of the cutting element.

18. A cutting structure according to claim 13, wherein the shaped surface is smoothly and concavely curved as it extends towards the cutting element.

19. A cutting structure according to claim 13, wherein the shaped surface is hard faced.

20. A cutting structure according to claim 13, wherein the shaped surface includes a portion faced with superhard material.

21. A cutting structure according to claim 20, wherein a further preform compact, comprising a front facing table of superhard material bonded to a less hard substrate, is mounted on the member so that the front face of the superhard material forms part of said shaped surface on the member.

* * * * *